US007762095B2

(12) United States Patent
Hahn

(10) Patent No.: US 7,762,095 B2
(45) Date of Patent: Jul. 27, 2010

(54) SHOWCASE FOR STORING AND/OR DISPLAYING OBJECTS

(75) Inventor: Thomas Hahn, Frankfurt am Main (DE)

(73) Assignee: Glasbau Hahn GmbH & Co. KG, Franfurt am Main (DE)

( * ) Notice: Subject to any disclaimer, the term of this patent is extended or adjusted under 35 U.S.C. 154(b) by 566 days.

(21) Appl. No.: 11/597,958

(22) PCT Filed: Jun. 3, 2005

(86) PCT No.: PCT/EP2005/005973

§ 371 (c)(1),
(2), (4) Date: Nov. 29, 2006

(87) PCT Pub. No.: WO2005/120297

PCT Pub. Date: Dec. 22, 2005

(65) Prior Publication Data

US 2007/0251252 A1 Nov. 1, 2007

(30) Foreign Application Priority Data

Jun. 7, 2004 (DE) ..... 10 2004 027 750

(51) Int. Cl.
*A47F 3/04* (2006.01)

(52) U.S. Cl. ..... 62/247; 62/78

(58) Field of Classification Search ..... 62/78, 62/246–256

See application file for complete search history.

(56) References Cited

U.S. PATENT DOCUMENTS 3,650,039 A 3/1972 Harding
5,127,233 A * 7/1992 Coffield ..... 62/78
5,505,056 A * 4/1996 Jones ..... 62/78
5,649,995 A * 7/1997 Gast, Jr. ..... 95/12
5,799,495 A * 9/1998 Gast et al. ..... 62/78
6,092,430 A * 7/2000 Liston et al. ..... 73/863.81

FOREIGN PATENT DOCUMENTS

| | | |
|---|---|---|
| DE | 3905212 | 8/1989 |
| DE | 3908365 | 9/1990 |
| DE | 69418115 | 2/1994 |
| DE | 19826930 | 6/1998 |
| EP | 0298531 | 1/1989 |
| WO | WO 02/100218 | 12/2002 |

OTHER PUBLICATIONS

International Search Report.

* cited by examiner

*Primary Examiner*—William E Tapolcai
(74) *Attorney, Agent, or Firm*—Bucknam and Archer

(57) ABSTRACT

A showcase for storing and/or displaying objects which require a protective gas atmosphere, the base and the cover construction of the showcase more or less surrounding the showcase interior which is sealed in an airtight manner as far as possible relative to the exterior air, having a compressor (2) by which the air (1) present outwith the showcase interior (7) is suctioned in and compressed. Subsequently a protective gas is produced from the compressed air by a gas producer (3) and is supplied to the showcase interior (7), the gas producer (3) being able to be accommodated within or outwith the showcase. In this way, provision of a supply container for the protective gas is avoided.

4 Claims, 1 Drawing Sheet

SHOWCASE FOR STORING AND/OR DISPLAYING OBJECTS

CROSS REFERENCE TO RELATED APPLICATIONS

Figure 1:
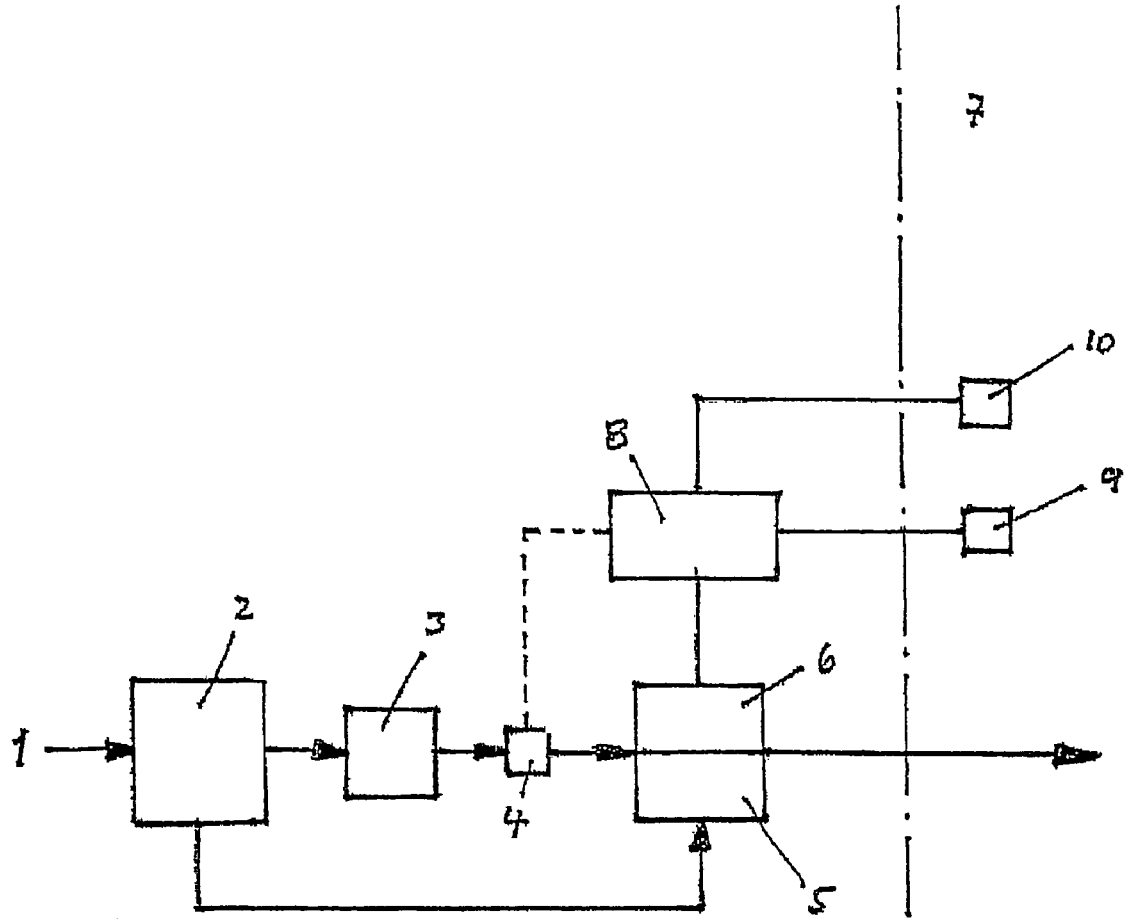

Applicant claims priority under 35 U.S.C. §119 of German Application No. 10 2004 027 750.8 filed Jun. 7, 2004. Applicant also claims priority under 35 U.S.C. §365 of PCT/EP2005/005973 filed Jun. 3, 2005. The international application under PCT article 21(2) was not published in English.

The invention relates to a showcase for storing and/or displaying objects, the base of which and the cover construction of which more or less surround the showcase interior which is sealed in an airtight manner as far as possible relative to the exterior air.

A showcase of this type is already known. A showcase for storing and/or displaying objects is thus described in DE-PS 38 05 212 C2, in which the surrounding air in the interior of the showcase, in order to protect the exhibited objects, is kept not only dust-free but also within the scope of desired air humidity. Apart from the absence of dust, the air humidity etc., the case can also occur now that, in addition to the mentioned requirements, specific objects in the interior of the showcase require a neutral environment. Therefore, it is also possible to fill the interior with a neutral gas if the protection of the exhibited objects requires it. In this connection, it is already known to use a gas for this purpose which is provided in a supply container.

A supply container of this type has the disadvantage that it must be monitored constantly with respect to its level of fullness. The object of the invention now resides in indicating a showcase, the interior of which contains a gas, it being ensured that special monitoring of the gas supply is avoided.

This object is achieved in that a compressor is provided by which the air present outwith the showcase interior is suctioned in and compressed and in that a protective gas is produced from the compressed air by a gas producer and is supplied to the showcase interior, the gas producer being accommodated within or outwith the showcase.

By producing the protective gas in situ, a supply container for the protective gas can be dispensed with. According to the embodiment, the compressor and the gas producer can now represent a component of the showcase but it is also possible to provide a compressor and a gas producer outwith the showcase either for one showcase or also for respectively a plurality of showcases.

A further embodiment of the invention resides in the protective gas being supplied to a humidifying device before introduction into the showcase interior. If in addition to the protective gas atmosphere a special atmospheric environment is required in the showcase interior, then the humidity of the protective gas can be adjusted and/or regulated with the help of the humidifying device.

This is particularly advantageous in connection with a cooling device, the latter operating together with the humidifying device.

Further advantages are produced from the sub-claims.

The invention is explained in more detail with reference to an embodiment which is represented in the drawing.

The incoming air 1 from the surroundings of the showcase is suctioned in by a compressor 2 and compressed, for example to a value of 6 to 8 bar. This air is supplied to a gas producer 3 which separates nitrogen gas from the air with the help of an arrangement of membranes. The unrequired residual components of the air which are produced in the process are supplied to the surroundings of the showcase. A gas producer of this type comprises an arrangement of membranes which are accommodated in a closed housing, air being able to be supplied to the inlet thereof and nitrogen gas being able to be withdrawn at an outlet. Its construction is described in EP-OS 0 298 531 A1 (gas separation apparatus and also method for separation gases by means of such apparatus), as a result of which the structure of the membranes and the mode of operation thereof is not dealt with further within the scope of this description. It can be deduced from the description of the mentioned publication that air must be forced into the housing at a fairly high pressure.

The nitrogen gas which has a high pressure is reduced by a pressure reduction valve 4 to a value which corresponds to a small excess pressure relative to air pressure outwith the showcase. The nitrogen gas which has only a relative humidity of 0-6% can now be conducted into the interior 7 of the showcase. As a result of the small excess pressure of the nitrogen gas in the interior of the showcase relative to the exterior air, a pure nitrogen atmosphere can now be set in the course of a few hours even after opening the showcase since a showcase of the initially mentioned type is never entirely sealed relative to the exterior air.

If in addition a special atmospheric environment is desired in the interior 7 of the showcase, i.e. in addition a specific temperature and a prescribed humidity of the protective gas, then nitrogen gas emerging at the outlet of the pressure reduction valve 4 must firstly be supplied to a humidifying device 5 through which said gas is correspondingly enriched with moisture. The humidifying device 5 can operate for example in such a manner that the nitrogen gas is conducted over a water surface and in this way absorbs moisture. By subsequent cooling of the moist protective gas with the help of a cooling device 6 its humidity and temperature can be adjusted and regulated, the air humidity is thereby brought to a prescribed value, for example 35 to 65%. Since during compression of the incoming air containing condensed water in the compressor 2 water is produced as a result of the air humidity, this can be collected and used advantageously to supplement the water supply of the humidifying device 5.

In the interior 7 of the showcase, a temperature sensor 9 and a pressure sensor 10 are fitted, both sensors are connected electrically to an electronic control device 8. With the help of the control device 8, the temperature of the cooling device 6 is adjusted or regulated to prescribable values as a function of the measurement values of the temperature sensor 9 and hence the temperature and the humidity of the nitrogen gas in the interior of the showcase 7. The pressure reduction valve 4 can now be set manually in a fixed manner at a specific value. It is however also conceivable that the pressure reduction valve 4 can be set by the control device 8 as a function of the measurement values of the pressure sensor 10. Hence the excess pressure in the interior 7 of the showcase can be increased slightly for example after opening and closing the showcase for a prescribed period of time in order to achieve that the interior 7 of the showcase fills more rapidly again with the nitrogen gas in that the air which has penetrated is forced out as a result of leaks. The control device 8 can in this case be connected electrically in addition to a not shown door switch or gas-tightness sensor.

The compressor 2 and the gas producer 3 can now be accommodated in the showcase itself and in fact expediently in the underpart thereof. It is however also conceivable to dispose instead the two mentioned devices outwith the showcase. Furthermore it is possible to provide a common compressor 2 and gas producer 3 for respectively a plurality of showcases, the produced nitrogen gas then being supplied to the individual showcases via hosepipes.

The invention claimed is:

1. A showcase for storing and/or displaying objects having a base and a cover construction surrounding an interior of the showcase which is sealed in a substantially airtight manner relative to the exterior air, said showcase further including:

a compressor (2) is supplied with air (1) from the exterior of the showcase and compresses said air;

a gas producer (3) receives the compressed air from said compressor (2) and produces nitrogen gas from said compressed air, said gas producer (3) is arranged within said showcase;

a humidifying device (5) is supplied with water produced from the compressed air compressed in said compressor (2) and humidifies the nitrogen gas produced by said gas producer (3); and a cooling device (6) communicating with said humidifying device (5) adjusts and/or regulates the humidity of said nitrogen gas which is then supplied to an interior (7) of said showcase.

2. The showcase according to claim 1, wherein the introduction of the nitrogen gas into the showcase interior (7) is effected by maintaining a small excess pressure relative to the exterior air.

3. The showcase according to claim 1, wherein a temperature sensor (9) connected to a control device (8) is fitted in the interior (7) of the showcase, the cooling device (6) being adjusted and/or regulated by the control device (8).

4. The showcase according to claim 3, wherein a pressure sensor (10) is fitted in the interior (7) of the showcase which is connected to the control device (8) connected to a pressure reduction valve (4), by which valve the pressure of the nitrogen gas produced by the gas producer (3) is adjustable.

* * * * *

UNITED STATES PATENT AND TRADEMARK OFFICE

CERTIFICATE OF CORRECTION

PATENT NO. : 7,762,095 B2
APPLICATION NO. : 11/597958
DATED : July 27, 2010
INVENTOR(S) : Thomas Hahn It is certified that error appears in the above-identified patent and that said Letters Patent is hereby corrected as shown below:

In particular, on the cover page, Item [73], please change the city of the Assignee from "Franfurt am Main" to correctly read: --Frankfurt am Main--.

Signed and Sealed this

Seventh Day of September, 2010

David J. Kappos

David J. Kappos
*Director of the United States Patent and Trademark Office*